US005884521A

United States Patent [19]

Fidziukiewicz

[11] Patent Number: 5,884,521

[45] Date of Patent: Mar. 23, 1999

[54] HIGH PERFORMANCE AERIAL AND DIE MOUNT CAMS

[75] Inventor: Erich D. Fidziukiewicz, Canton, Mich.

[73] Assignee: Lamina, Inc., Oak Park, Mich.

[21] Appl. No.: 113,716

[22] Filed: Jul. 10, 1998

[51] Int. Cl.[6] ..... B21D 5/04

[52] U.S. Cl. ..... 72/452.9; 72/381; 72/304; 72/315; 83/635

[58] Field of Search ..... 72/304, 315, 452.9, 72/381; 83/588, 627, 635

[56] References Cited

U.S. PATENT DOCUMENTS

| | | | |
|---|---|---|---|
| 5,101,705 | 4/1992 | Matsuoka . | |
| 5,231,907 | 8/1993 | Matsuoka . | |
| 5,269,167 | 12/1993 | Gerhart | 72/452.9 |
| 5,487,296 | 1/1996 | Gerhart et al. . | |
| 5,711,180 | 1/1998 | Sasahara et al. | 72/452.9 |

FOREIGN PATENT DOCUMENTS

| | | | |
|---|---|---|---|
| 3-5018 | 1/1991 | Japan | 72/452.9 |
| 1402-386 | 6/1988 | U.S.S.R. | 72/452.9 |
| 1563-809 | 5/1990 | U.S.S.R. | 72/452.9 |

*Primary Examiner*—David B. Jones
*Attorney, Agent, or Firm*—Brooks & Kushman P.C.

[57] ABSTRACT

Aerial and die mounted cams are provided with dual opposed wearplates on bearing surfaces.

5 Claims, 4 Drawing Sheets

HIGH PERFORMANCE AERIAL AND DIE MOUNT CAMS

This invention relates to improvements in Aerial and Die Mount Cams and, in particular, to improvements in the sliding bearing surfaces between operating parts thereof whereby greater loading may be borne by the cams and their life prolonged.

TECHNICAL FIELD

This invention relates to improvements in machine tool design.

BACKGROUND OF THE INVENTION

The following U.S. patents are incorporated by reference herein and disclose representative Aerial and Die Mount Cams:

U.S. Pat. No. 5,487,296

U.S. Pat. No. 5,101,705

U.S. Pat. No. 5,231,907

In these references, as the ram of the press is lowered, camming surfaces react between relatively slidable parts to cause a tool to be shifted laterally against a workpiece to effect some stamping, bending, punching or like operations thereon. Such slidable parts are subject to wear at their relatively sliding surfaces. As the accuracy or precision of the press is dependent on repeatability in the movement of its parts, it is extremely important that the wearing surfaces between the sliding parts not be allowed to degrade, and this has led to the necessity of frequently replacing worn surfaces.

Heretofore, it has been common practice to provide wear plates of relatively soft metal on one of the sliding parts. Such plates bear against cast iron surfaces of the opposing part, so that such plates rather than the opposing cast iron part wear away. While this has proven to be helpful, it still has required periodic replacement which may result in downtime for the press during production runs, which becomes a very costly procedure.

In addition, certain prior art, particularly U.S. Pat. No. 5,101,705, discloses a guide arrangement between the slide cam base 13 (sometimes referred to as a cam adapter) and the tool holder or slide cam 17 which prevents meandering of the slide cam 17 (and in turn the tool 43 carried thereby) in the event of wear between the opposed sliding surfaces of the cam adapter and the slide cam. While such design may prevent wandering or meandering of the slide cam, it limits the effective loading that can be imposed between the relatively sliding parts, not merely because of the limited surface area between the parts across which the loading is to be spread, but also because of the design, the working loads impose substantial tensile stresses on the slide cam which are directed laterally as viewed in FIG. 2 of such patent. These stresses are in a direction which tends to fracture the slide cam along a vertical plane coincident with the crest line 15, and thus the design substantially limits the effective working loads the slide cam can safely handle.

SUMMARY OF THE INVENTION

To provide a very long life for the sliding surfaces of Die Mount and Aerial Cams, I provide double wear plates arranged in cooperating opposed relation at all heavily loaded relatively sliding surfaces, such that the cast iron of which the slide cam, the cam adapter or the cam driver are made is no longer relied upon to provide bearing surfaces for the major working loads. For example, the bearing surfaces of the slide cam may be made of hardened steel while the opposed surfaces of the cam adapter and the cam driver are made of bronze. Such bearing or wear plates are provided with lubricating means such as lubricating plugs. I incorporate this improvement in a rearrangement in the design of the load bearing surfaces such that some surfaces are provided for withstanding the substantial working loads and separate and distinct surfaces are provided for preventing wandering of the slide cam. The aforementioned double wear plates are located at the surfaces which carry the major working loads, while the light loads associated with simply guiding or connecting the slide cam and cam adapter together may be of conventional design.

To substantially increase the tonnage capacity of the aerial and die mount cams, I utilize a conventional pentagonal design for the relatively sliding opposed surfaces between the slide cam and the cam adapter which not only prevents wandering of the slide cam but also gives a larger bearing area over which the loading may be distributed. This arrangement also avoids the problem of relying on bearing surfaces so disposed that large laterally directed forces are imposed on the slide cam that subject it to fracture as aforesaid. All this is accomplished by eliminating the crest line 15 of U.S. Pat. No. 5,101,705 and providing broad flat opposed bearing surfaces for carrying the principal loading between the ram, the tool holder and the cam driver.

BRIEF DESCRIPTION OF THE PREFERRED EMBODIMENT

Figure 1:
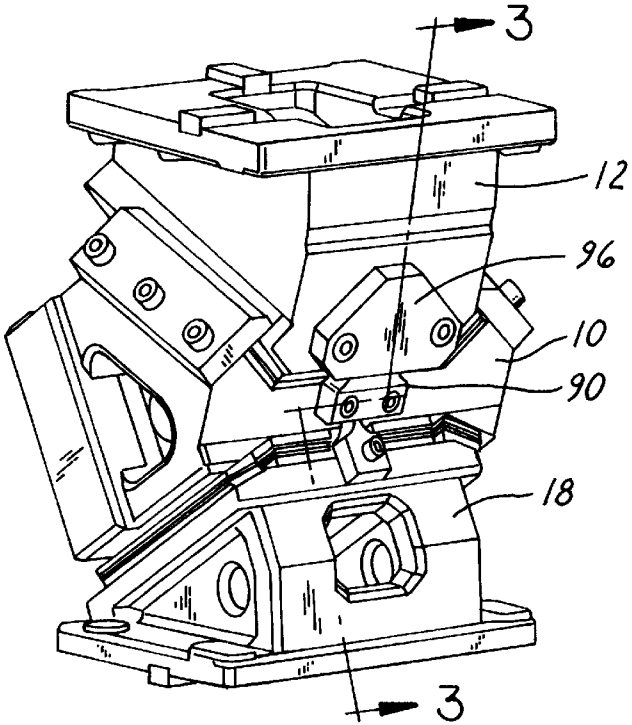
FIG. 1 is a perspective view of an aerial die cam unit.

In FIG. 1, I have shown a representative aerial die cam unit having a tool holding member or slide cam 10 suspended from a vertically movable cam adapter (sometimes referred to in the prior art as a slide cam base or ram adapter) 12 which is intended to be secured to the upper die shoe 14 of the press by bolts 16, similar to securement of the slide cam base 13 to the upper die shoe 11 in U.S. Pat. No. 5,101,705.

A cam driving member 18 is intended to be secured to the lower die shoe 20 of the press as by bolts 22 similar to securement of the driver 8 by bolts 9 to the bed of the press 1 shown in U.S. Pat. No. 5,101,705.

Figure 3:
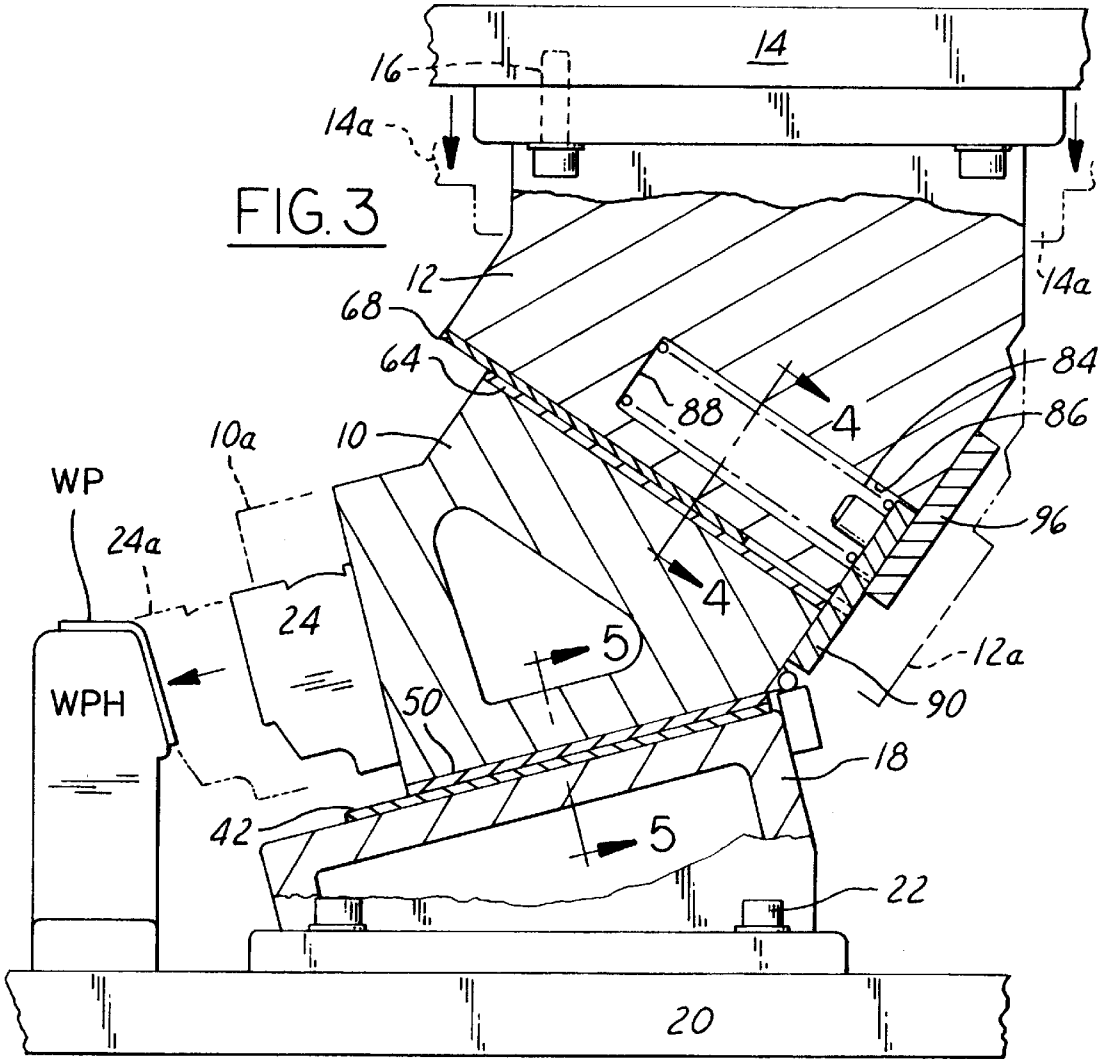
FIG. 3 is a cross-sectional view taken on the line 3—3 of FIG. 1.

As the upper die shoe of the press 14 descends to the phantom outline position 14A in FIG. 3, it carries the cam adapter 12 downwardly to the phantom outlined position 12A in FIG. 3, during which the tool holder or slide cam 10 engages the cam driving member 18 causing the tool holder to be shifted laterally from the solid outlined position to the phantom outlined position 10A and, in turn, shifting the tool 24 carried by the tool holder to the position 24A shown in FIG. 3. In this latter position, tool 24 will perform its working function upon a workpiece WP held in position by a workpiece holder WPH secured to the bed 20 of the press. The tool 24 may either bend, punch, stamp, cut or otherwise treat the workpiece during the aforesaid lateral movement of the tool from the solid outlined to the phantom outlined positions of FIG. 3.

Thus, it is apparent that there are opposed relatively sliding surfaces between the tool holder 10, the cam adapter 12 and the driver 18. These relatively sliding surfaces are subject to wear upon downward movement of the upper die shoe 14. In practice, it has been conventional as shown in U.S. Pat. No. 5,269,167 to provide replaceable inserts 74 and 76 in the tool holding cam member 34 (referred to in such patent as the slide block) and in the rear plate 52 (equivalent of cam adapter) of such patent. Similarly, in U.S. Pat. No. 5,101,705 wear plates are shown at 23 in FIG. 2 mounted on the tool holder or slide cam and bearing against the cast iron of the slide cam base 13 (equivalent of the cam adapter). In both patents the wear plates engage and ride against the cast iron of which the adapter or slide cam are made.

Figure 4:
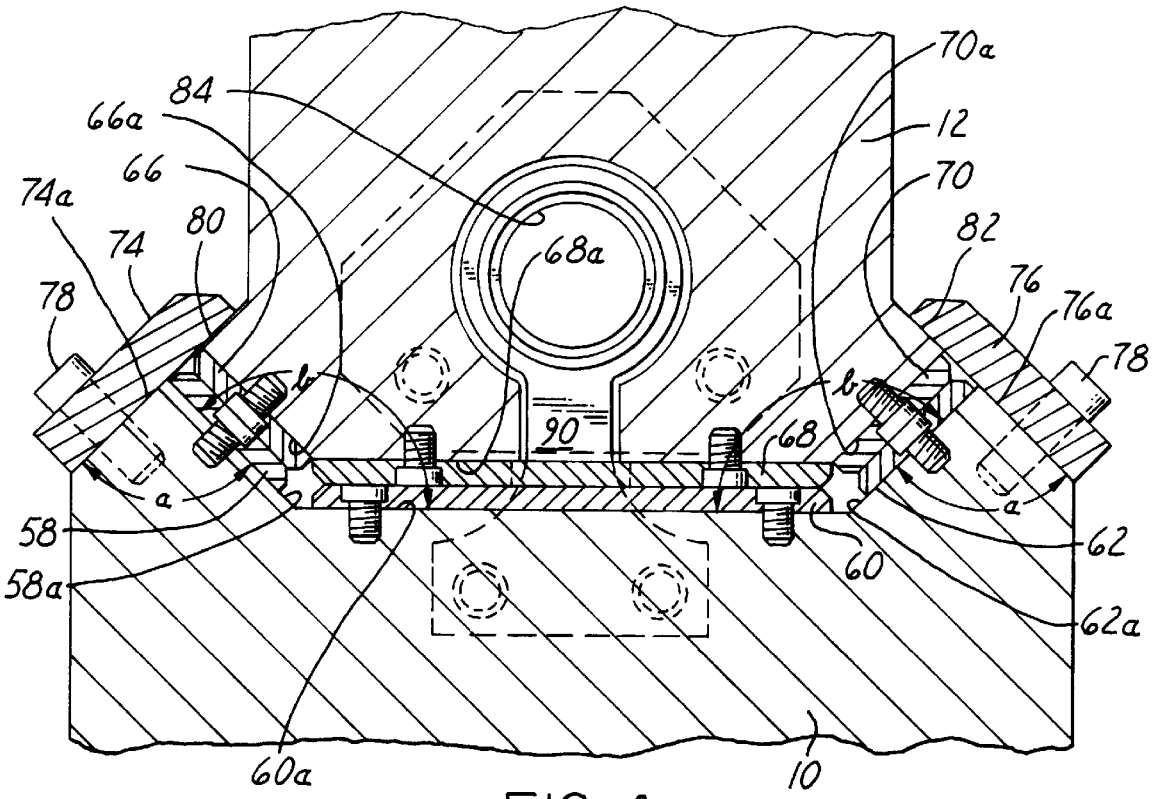
FIG. 4 is a cross-sectional view taken on the line 4—4 of FIG. 3.
Figure 5:
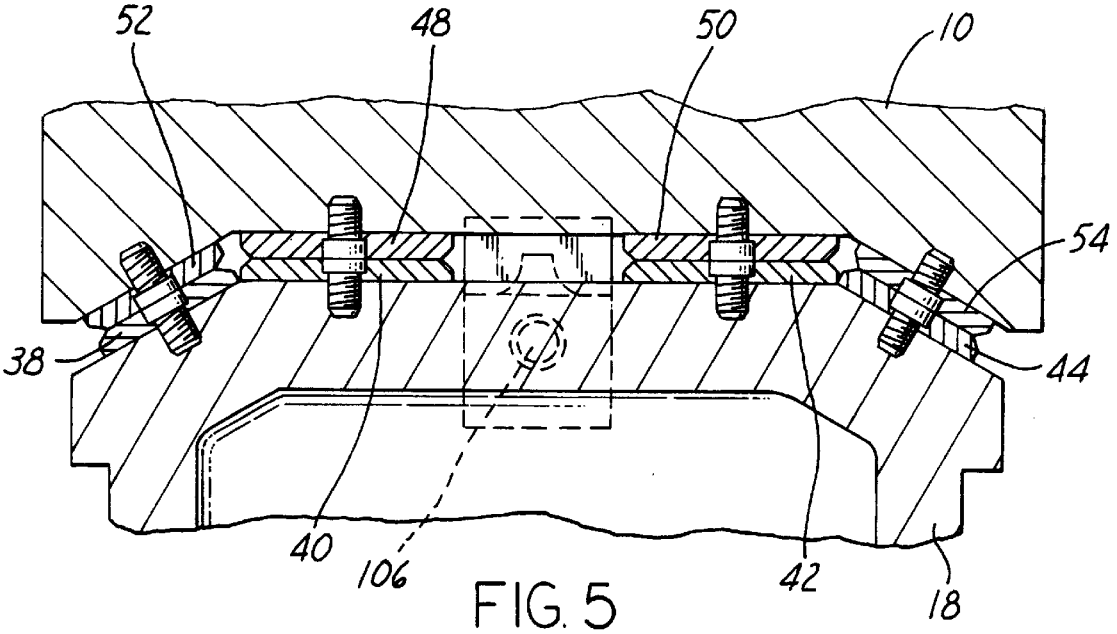
FIG. 5 is a cross-sectional view taken on the line 5—5 of FIG. 3.

In my disclosure, the slide cam or tool holder 10 is provided with surfaces arranged in a pentagonal configuration having a central surface 60*a*disposed substantially perpendicular to the principal working loads between the cam adapter and the slide cam, with a pair of guiding surfaces 58*a* and 62*a* along opposite edges of the central surface 60*a*, and a pair of coupling surfaces 74*a* and 76*a* along the outer edges of the guiding surfaces, as best shown in FIG. 4. The guiding and coupling surfaces are disposed at an acute angle a. The guiding surfaces are disposed at obtuse angles b to the central planar surface 60*a*.

The cam adapter 12 also has surfaces arranged in a pentagonal configuration. There is a central planar surface 68*a* disposed substantially perpendicular to the principal working loads between the cam adapter and the slide block during operation of the press. This central surface complements the central surface 60*a* of the slide block. A pair of guiding surfaces 66*a* and 70*a* are arranged along the opposite edges of the central surface 68*a* of the cam adapter opposing the guiding surfaces 58*a* and 62*a* of the slide cam. There is also a pair of coupling surfaces 80 and 82 along the outer edges of the guiding surfaces 66*a* and 70*a*. Similar to the pentagonal surfaces of the slide cam, the corresponding surfaces on the cam adapter have the guiding surfaces 66*a* and 70*a* arranged at an obtuse angle to the central surface 68*a*, and the coupling surfaces 80 and 82 are arranged at an acute angle to the guiding surfaces 66*a* and 70*a*.

Opposed double wear plates 60 and 68 are secured to the opposed central surfaces 60*a* and 68*a* of the slide cam and cam adapter, respectively, by fasteners 56. Opposed double wear plates 58 and 66, and 62 and 70 are secured by fasteners 46 to the guiding surfaces 58*a* and 66*a* and the guiding surfaces 62*a*25 and 70*a* of the slide cam and cam adapter respectively. Finally, a pair of wear plates, also known as keeper plates, 74 and 76 are secured by fasteners to the coupling surfaces 74*a* and 76*a* to slidably overlie the cast iron coupling surfaces 80 and 82 of the cam adapter 12. The overlap of the keeper plates 74 and 76 with respect to the surfaces 80 and 82 will, it is apparent, suspend the tool holder 10 from the cam adapter 12 for vertical movement therewith.

One plate of each pair of double wear plates may be made of one material, such as steel, while the opposite plate may be made of bronze, as hereinafter mentioned. The plates 38 and 52, and the plates 44 and 54 are guiding plates. They constitute means for guiding the tool holder 10 and preventing it from meandering during its sliding movement.

My design is such that when the trilateral configuration of plates 48,50,52 and 54 are first secured to the slide cam 10, and the trilateral configuration of plates 38,40,42 and 44 are first secured to the cam driver 18, and the slide cam and driver are brought into contact at the abutting plate surfaces, there is a slight clearance, on the order of 0.0005" between the opposed surfaces of the 40/48 and 42/50 pairs of plates while the two pairs of guiding plates 38/52 and 44/54 are in abutment. The press is then repetitively cycled during a break-in phase and the load is carried by the guiding plates 38/52 and 44/54 which wear down sufficiently to allow the principal bearing plate pairs 40/48 and 42/50 to come into full seating contact and carry the principal loading between the slide cam 10 and the cam driver 18. Thus, a very accurate way is provided to ensure accurate guided movement of the tool holder 10 during operation of the press while at the same time providing a very long useful life.

As is understood in this art, the aerial cam 10 shown in this application will be spaced upwardly from the driver 18 until the upper die shoe 14 has descended sufficiently to bring the opposed plates into abutting, sliding contact. Similarly, when the upper die shoe ascends, the tool holding slide cam 10 will be raised away from the driving member thereby separating the opposed wear plates 38/52, 40/48, 42/50 and 44/54.

The ability of my design to handle greater tonnages is due not only to the increased surface area between the relatively sliding surfaces and their arrangement substantially perpendicular to the principal loading between the driver, tool holder and cam adapter, but also to the fact that all of the sliding surfaces subjected to substantial loadings now comprise wear plates.

The wear plates overcome the problem of having one of the sliding surfaces made of cast iron which does not provide the smooth surface and desirable wear characteristics that can be attained by the use of separate wear plates. The plates can be self-lubricating bronze, against a hardened steel opposing surface. For example, the plates 58, 60 and 62 may be of hardened steel while plates 66, 68 and 70 may be of self-lubricating bronze. Self-lubricating bearing plugs are offered to the trade by Hicomp, Inc. of 17960 Englewood Drive, Cleveland, Ohio which can be embedded in the wear plates in conventional fashion.

In addition to making the plates of self-lubricating bronze, they may be made of self-lubricating hardened steel (utilizing lubricating plugs or other lubricating means as well understood in the art). They may also be made of fiber or sintered metal (treated to contain a lubricant) or any other suitable self-lubricating material. A preferred form is to have the plates of self-lubricating bronze or self-lubricating sintered metal.

Figure 2:
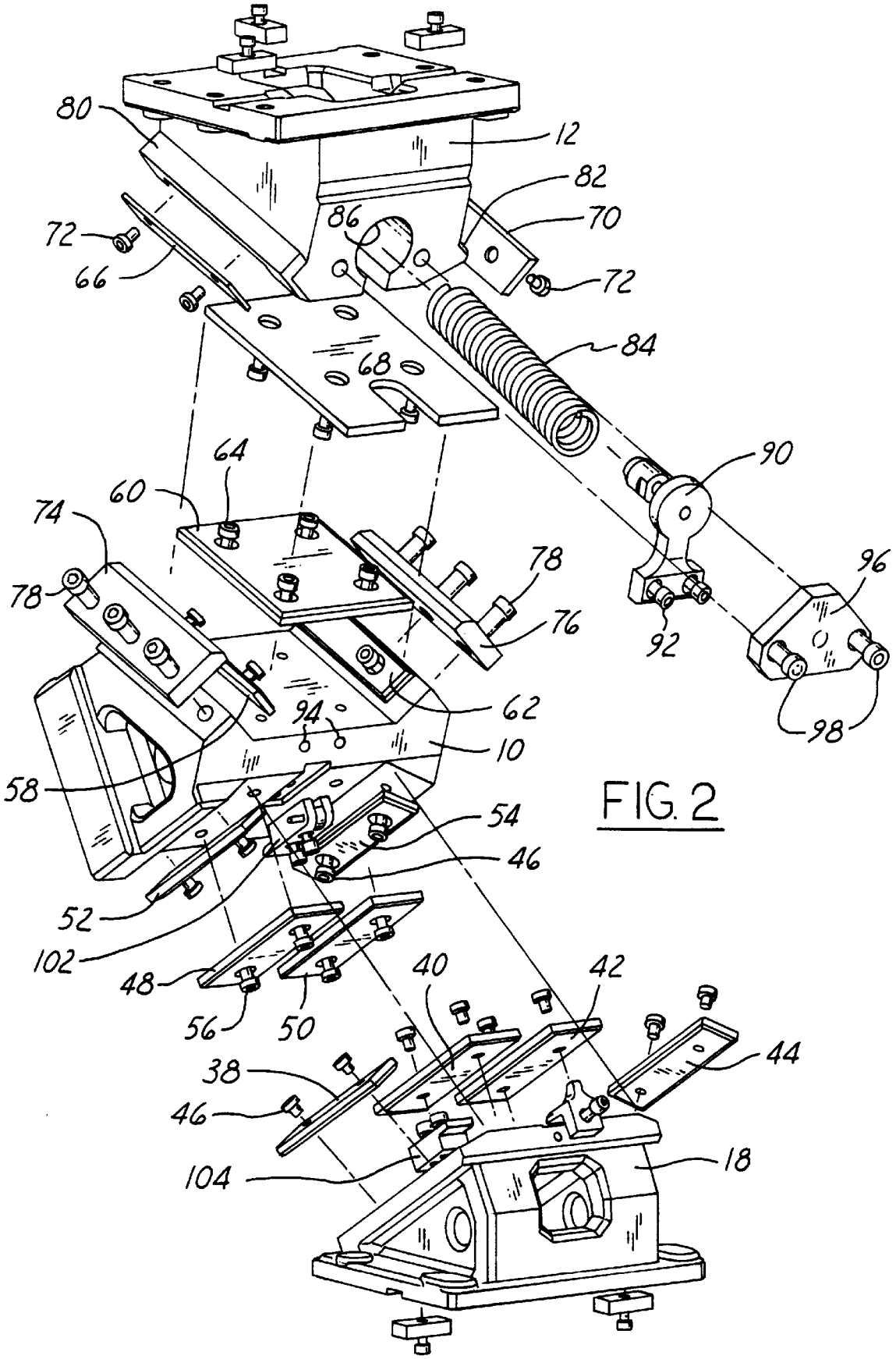
FIG. 2 is an exploded view of the aerial die cam unit of FIG. 1.

Conventional die return springs as well as positive return elements may be employed in the aerial die unit. In FIG. 2, I have shown a return coil spring 84 which is received in a bore 86 with one end of the spring bearing against the closed end 88 of such bore. The opposite end of the spring engages a spring bracket 90 which is held by the fasteners 92 in the apertures 94 of the tool holder 10. A stop block 96 overlies member 90 and is secured by fasteners 98 to the cam adapter 12. Spring 84 serves to return the tool holder 10 back to its at-rest position when the upper die shoe 14 rises. In addition, there are cooperating, positive return members 102 and 104 which inter-engage when the tool holder is lowered to bear against the driver 18. These elements serve to positively return the tool holder up the incline of the driver when the upper die shoe 14 rises. Such positive return devices are conventional in the art and need not be further described. A nitrogen return spring in the driver 18 is indicated schematically at 106. Return springs of this nature are conventional in the art and need not be further described.

Figure 6:
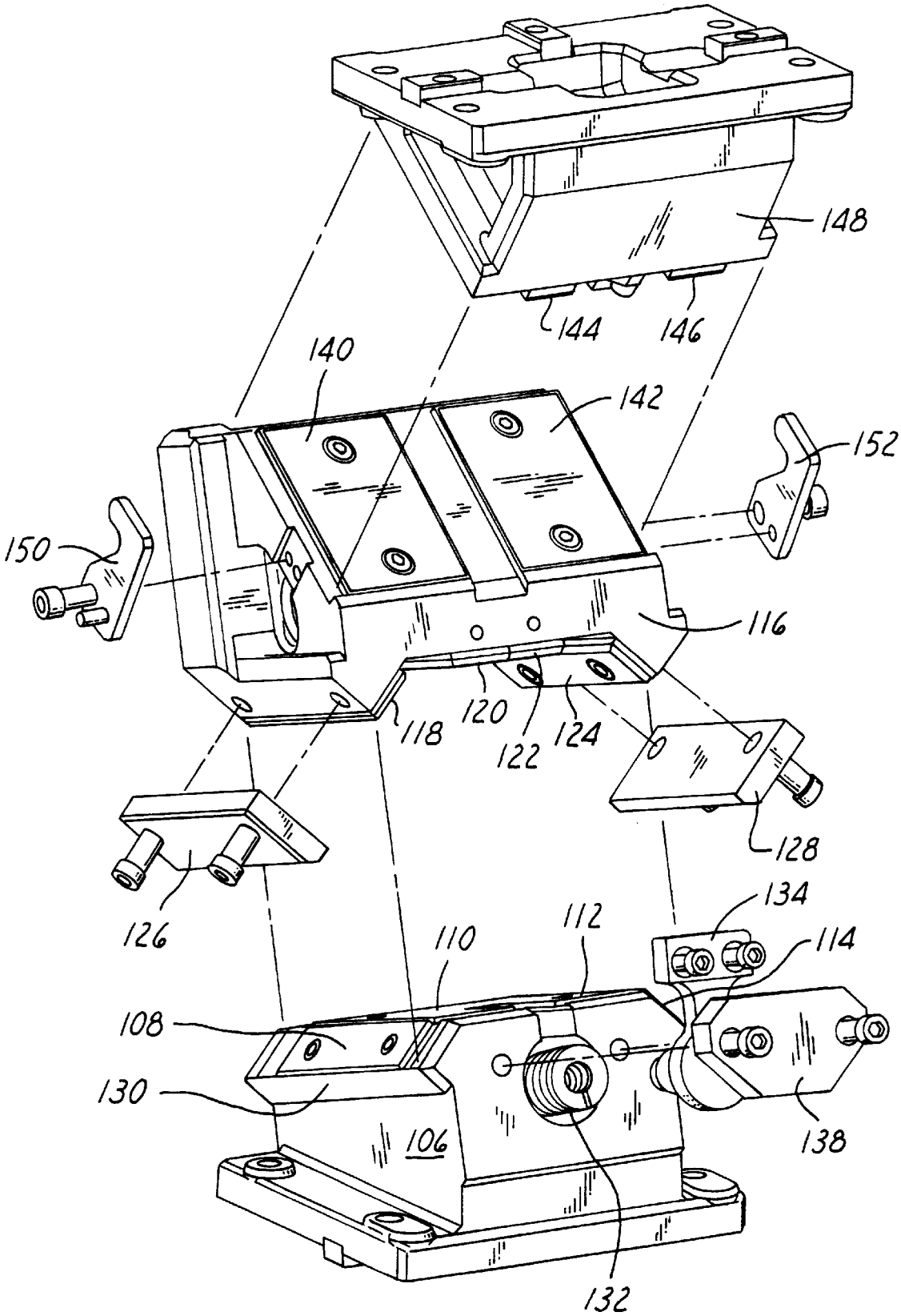
FIG. 6 is an exploded view of a die-mounted cam embodying my invention.

In FIG. 6, I have shown an exploded view of a die mount cam whose general operation will be understood by those skilled in this art. A cam adapter 106 is adapted to be mounted on the lower die of the press as in the case of FIG. 3 and is of pentagonal shape in cross-section. Four self-lubricating bronze or the like wear plates 108, 110, 112 and 114 are secured to the cam adapter similar to the securement of the plates in FIG. 2. The plates are arranged to exactly match the pentagonal shape of the surfaces of the slide block or tool holder 116 which is also provided with four wear plates 118, 120, 122 and 124. The slide block 116 and the cam adapter 106 are secured against separation by keeper plates 126 and 128 which are made of a self-lubricating bearing material adapted to ride on the cast iron faces 130 at opposite sides of the cam adapter (only one such surface being shown in FIG. 6). The wear plates 118, 120, 122 and 124 may be made of hardened steel if desired or any other suitable bearing material for cooperation with the opposed plates 108, 110, 112 and 114 which may be a selflubricating bronze. A return coil spring 132 is provided in a suitable bore in the cam adapter and a spring bracket 134 overlies the end of the spring and is fastened in the apertures 136 in the tool holder or slide block 116. A stop block 138 is secured to the cam adapter 106 to overlie the spring bracket and limit the return movement of the slide block 116.

Plates 110 and 112 and their opposed pair 120 and 122 have bearing faces lying in a plane substantially perpendicular to the principal forces between the tool holder 116 and the cam adapter 106, and thus take the heaviest working loads. Both because of the square unit area of such faces, and the fact that both are covered by good bearing materials, the loadings imposed between the tool holder and the driver can be considerably greater than those of the prior art.

The slide block 116 is provided with a pair of self-lubricating wear plates 140 and 142 disposed in an inclined arrangement substantially perpendicular to the principal forces between the tool holder and the driver 148. Such plates are opposed to parallel wear plates 144 and 146 on the driver 148. The driver 148 is of course to be secured to the upper die shoe 14 in FIG. 3. As will be understood by those skilled in the art, when the ram descends, the driver 148 is carried against the slide block 116 such that the wear plates 140 and 142 are engaged by the plates 144 and 146 causing the slide block 116 to be moved down the incline of the cam adapter 106 to carry a tool (not shown) against a workpiece to perform an operation thereon, similar to that shown in FIG. 3. When the ram rises, the driver 148 will rise and the slide block 116 will be moved back toward the stop block 138 under the influence of the spring return 132 as well as the positive return detents 150 and 152 which engage corresponding cooperating elements (not shown) in the ram driver 148.

As with the aerial cam, the die mount cam shown in FIG. 6 incorporates self-lubricating wear plates in sliding opposition to the heavily loaded surfaces of the driver, slide block and cam adapter. The keeper plates 126 and 128 will ride on the angle surfaces of the die cast cam adapter 106 as there is little force between the slide block and cam adapter as the ram ascends.

What is claimed is:

1. Improvements in aerial and die mount cams comprising, in combination:

a slide cam having surfaces arranged in a pentagonal configuration having a central surface with a pair of guiding surfaces along opposite edges of the central surface and a pair of coupling surfaces along the outer edges of the guiding surfaces;

said guiding and coupling surfaces being disposed at an acute angle and said guiding surfaces being disposed at an obtuse angle to the central surface;

a cam adapter for engaging the slide cam to shift it and having surfaces arranged in a pentagonal configuration complementing the pentagonal arrangement on the slide cam and including a central surface opposed to the central surface of the slide cam, and a pair of guiding surfaces along opposite edges of the central surface of the cam adapter opposing and the guiding surfaces on the slide cam, and a pair of coupling surfaces along the outer edges of the last mentioned guiding surfaces;

said central surfaces being disposed substantially perpendicular to the major loading forces to be imposed on the slide cam and cam adapter;

opposed double wear plates secured to said opposed central and guiding surfaces;

said wear plates having a bearing surface formed of bearing material and at least one plate of each pair having means for lubricating the bearing surface of the plate; keeper plates secured to one of the pair of coupling surfaces and having a bearing surfaces slidably overlapping the other pair of coupling surfaces to connect the slide cam and cam adapter for conjoint movement; and one plate of each opposed pair of discrete wear plates is of harder material than the opposite plate.

2. The invention defined by claim 1 wherein the harder material is hardened steel.

3. The invention defined by claim 1 wherein said lubricating means comprises a plurality of lubricating plugs in said one plate.

4. The invention defined by claim 1 wherein one plate of each pair of double wear plates is formed of self-lubricating bronze and the opposite plate is of hardened steel.

5. The invention defined by claim 1 wherein said slide cam has a second group of surfaces arranged in a trilateral configuration having with a central planar surface and a pair of guiding surfaces along opposite edges;

a cam driver for engaging the slide cam to shift it and having surfaces arranged in a trilateral configuration complementing the trilateral surfaces of the slide cam and having a central planar surface opposed to the central planar surface of the second group of surfaces, and having a pair of guiding surfaces along opposite edges thereof opposed to the guiding surfaces of the second group of surfaces on the slide cam;

opposed double wear plates secured to the central planar surfaces of the slide cam and cam driver and to the guiding surfaces; and said double wear plates having opposed bearing surfaces, at least one of which has means for lubricating the bearing surfaces.

* * * * *